US005462227A

United States Patent [19]

Ping

[11] Patent Number: 5,462,227

[45] Date of Patent: Oct. 31, 1995

[54] AUTOMATIC CLEANING DEVICE FOR USE ON A STOCK FARM

[76] Inventor: Wu K. Ping, 62 Fu Tsao, Bie Jeau Li, Tu Koo Town, Yung Lin Hsien, Taiwan

[21] Appl. No.: 294,986

[22] Filed: Aug. 24, 1994

[51] Int. Cl.[6] ..... B05B 3/16

[52] U.S. Cl. ..... 239/227; 239/237; 239/263.3

[58] Field of Search ..... 239/237, 227, 239/252, 263, 239, 263.3

[56] References Cited

U.S. PATENT DOCUMENTS

| | | | |
|---|---|---|---|
| 2,784,034 | 3/1957 | Metcalf | 239/252 X |
| 2,865,672 | 12/1958 | Guinward | 239/252 |
| 2,943,796 | 7/1960 | Smith | 239/237 |
| 2,969,922 | 1/1961 | Butler | 239/237 X |
| 3,625,425 | 12/1970 | Robinson | 239/227 |
| 4,013,222 | 3/1977 | Travaglio | 239/227 X |
| 5,141,165 | 8/1992 | Sharpless et al. | 239/227 X |

FOREIGN PATENT DOCUMENTS

| | | | |
|---|---|---|---|
| 476553 | 1/1928 | Germany | 239/252 |
| 446949 | 10/1928 | Germany | 239/252 |
| 565717 | 11/1930 | Germany | 239/227 |
| 146444 | 10/1948 | Sweden | 239/252 |
| 282566 | 12/1927 | United Kingdom | 239/252 |

*Primary Examiner*—Kevin P. Weldon
*Attorney, Agent, or Firm*—Browdy and Neimark

[57] ABSTRACT

An automatic cleaning device for use on a stock farm, including an automatic switching system, a transmission case, a sprinkling system and a water pump. The automatic switching system utilizes water pressure to push a valve seat so as to achieve an automatically switching effect without using electric power. By means of a splined circular rod, a first and a second rotary rods and a one-way bearing in the transmission case in cooperation with a linking lever and connecting arch block of the sprinkling system, a linear movement of a slidable piston is converted into a speeded up and down pivoting and left and right swinging movement of a sprinkling head of the sprinkling system. A flow controlling mechanism of a hydraulic means is used to achieve alternate fast and slow cleaning operation of the sprinkling system. By means of changing pivot holes of a connecting block for pivotally connecting with the linking lever, a starting point of the sprinkling head is adjustable.

1 Claim, 10 Drawing Sheets

AUTOMATIC CLEANING DEVICE FOR USE ON A STOCK FARM

BACKGROUND OF THE INVENTION

The present invention relates to an automatic cleaning device for use on a stock farm.

It is known that the operation of most of the existing stock farms have been automatized and most of the works have been accomplished by mechanical equipments instead of human labor. For example, the animals raised in the stock farms are fed in an automatic manner. However, it is found that the existing stock farms mostly still clean up the excretion of the animals by human labor. This forms an obstruction to the automatization of the operation of the stock farms. Therefore, it is necessary to provide an automatic cleaning device for use on a stock farm so as to achieve the object of complete automatization of the operation of the stock farm.

SUMMARY OF THE INVENTION

It is a primary object of the present invention to provide an automatic cleaning device for use on a stock farm, which includes components and achieves functions as follows:

1. The present automatic cleaning device includes an automatic switching system, a transmission case and a sprinkling system, wherein the automatic switching system automatically switching the water flow without using electric power and the transmission converts a relatively slow linear movement of a slidable piston into a relatively fast rotary movement of a sprinkling head of the sprinkling system, whereby the sprinkling head can automatically swing up and down and left and right through a certain angle to sprinkle water for cleaning a stock farm. Therefore, the cleaning operation is automatized to save human labor and achieve an accurately cleaning effect.
2. The automatic switching system of the present invention includes a hydraulic means having a flow controlling mechanism for controlling amount of the hydraulic oil flow, whereby the sprinkling system can perform fast cleaning operation and slow cleaning operation alternately in such a manner that the water is first fast sprinkled to soak and loosen the excretion and dirt and then the water is slowly sprinkled to clean up the stock farm. According to the above procedure, the water is saved while the stock farm is more efficiently cleaned up.
3. A series of the cleaning devices can be fixed at intervals and connected with one another by water tubes. Therefore, the present cleaning device can be easily installed without using electric wires, plastic hoses, steel cables, etc. Also, the maintenance and service of the present cleaning device can be easily performed.
4. The water pressure is transmitted to serve to automatically switch the flowing direction, drive the transmission case and enable the sprinkling system to swing up and down and left and right during the sprinkling procedure. It is no more necessary to use a motor as the power source.
5. A linking lever is changeably pivoted at pivot holes of a U-shaped swinging block, whereby in case it is desired to clean a half area of the stock farm, the starting point of the sprinkling head can be adjusted so as to save great amount of water.

6. One single water pump is used to provide water for the cleaning devices one by one in an automatically switching manner so that the water is provided at strong pressure and the cleaning effect can be enhanced.
7. The present cleaning devices can be fixedly installed and thus can be connected with one another by hard plastic water tubes which are hardly damaged by mice or the like.

The present invention can be best understood through the following description and accompanying drawings, wherein:

DETAILED DESCRIPTION OF THE PREFERRED EMBODIMENT

Figure 1:
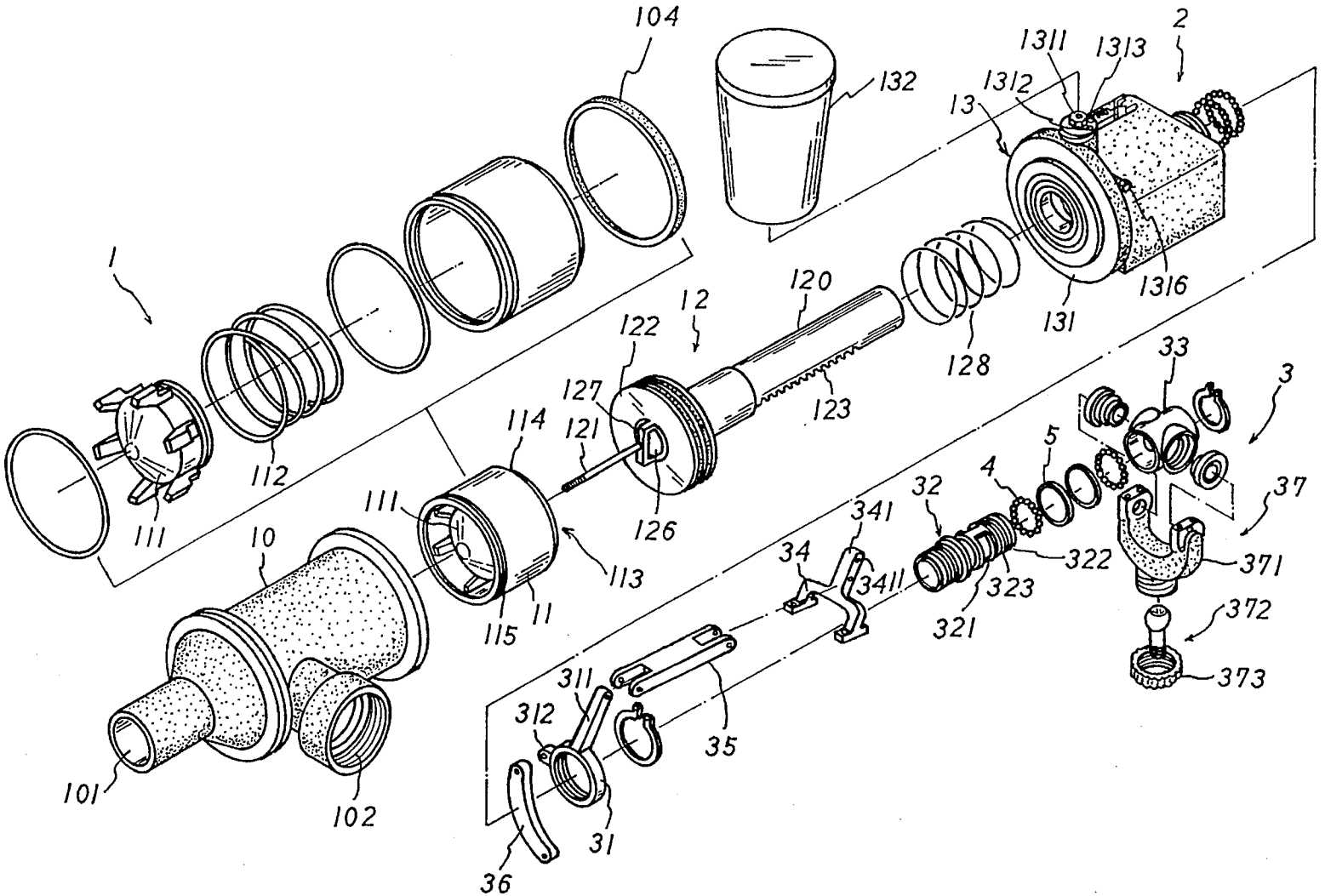
FIG. 1 is a perspective exploded view of the present invention.
Figure 2:
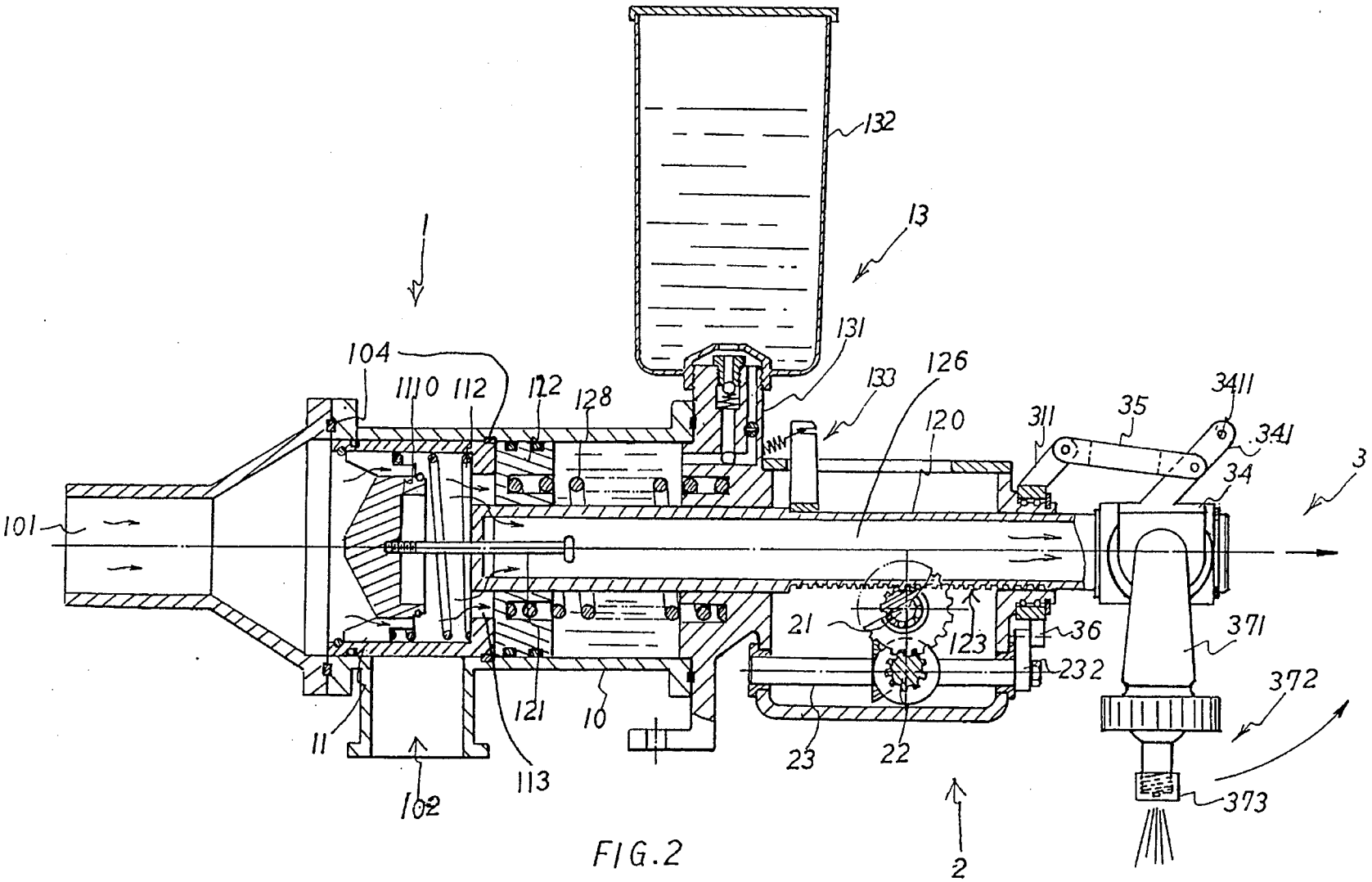
FIG. 2 is a sectional view of the present invention, showing the operation thereof for cleaning the entire stock farm.
Figure 3:
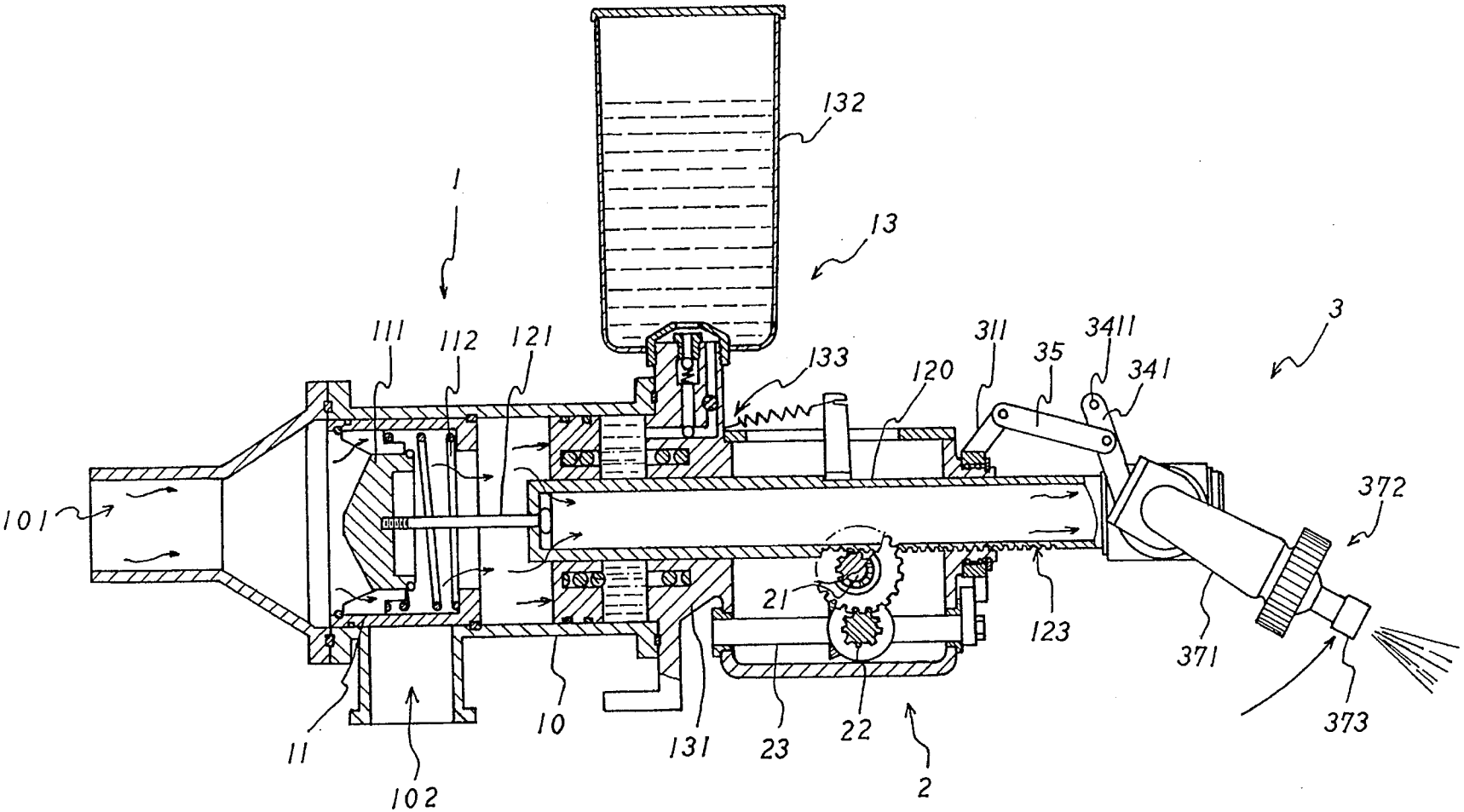
FIG. 3 is a sectional view according to FIG. 2 showing the operation of the present invention for cleaning a half area of the stock farm.

Please refer to FIGS. 1 to 3. The automatic cleaning device of the present invention includes an automatic switching system 1, a transmission case 2 and a sprinkling system 3.

The automatic switching system 1 includes a main body 10, a valve seat 11, a slidable piston 12 and a hydraulic means 13. The main body 10 has a water entrance 101 for receiving water sucked out by a water pump, a bypass 102 disposed on a lateral side of the main body 10, an interior space for containing the valve seat 11 and the slidable piston 12, and two O-rings 104 embedded in the main body 10 for restricting the valve seat 11 from moving.

The valve seat 11 has a conic valve body 111 disposed in the valve seat 11, a compression spring 112 disposed at a rear end of the conic valve body 111 and confined between a rear end and a water exit 113 of the valve seat 11. The water exit 113 of the valve seat 11 is smaller than the conic valve body 111 and thus can be blocked thereby. An engaging step portion 114 and an annular groove 115 are respectively formed at two ends of the valve seat 11 for engaging with the O-rings 104 of the main body 10. A thread hole 1110 is formed on a central portion of the rear end of the valve body 111.

The slidable piston 12 is a hollow tube member having a through hole 126. A sealing disk 122 is disposed at a front end of the slidable piston 12 for completely shutting off water flow. A shaft rod 120 axially extends from a rear end of the sealing disk 122. The shaft rod 120 is stepped, having a small diameter portion. A row of teeth are axially formed on outer wall of a bottom of the small diameter portion of the shaft rod 120. A U-shaped member 127 is fixedly disposed at a front end of the slidable piston 12 across the through hole 126. An orifice is formed at a central portion of the U-shaped member 127, whereby a linking rod 121 is undetachably inserted through the orifice to screw into the thread hole 1110 of the conic valve body 111. A restoring spring 128 is fitted on the shaft rod 120 of the slidable piston 12.

Figure 4:
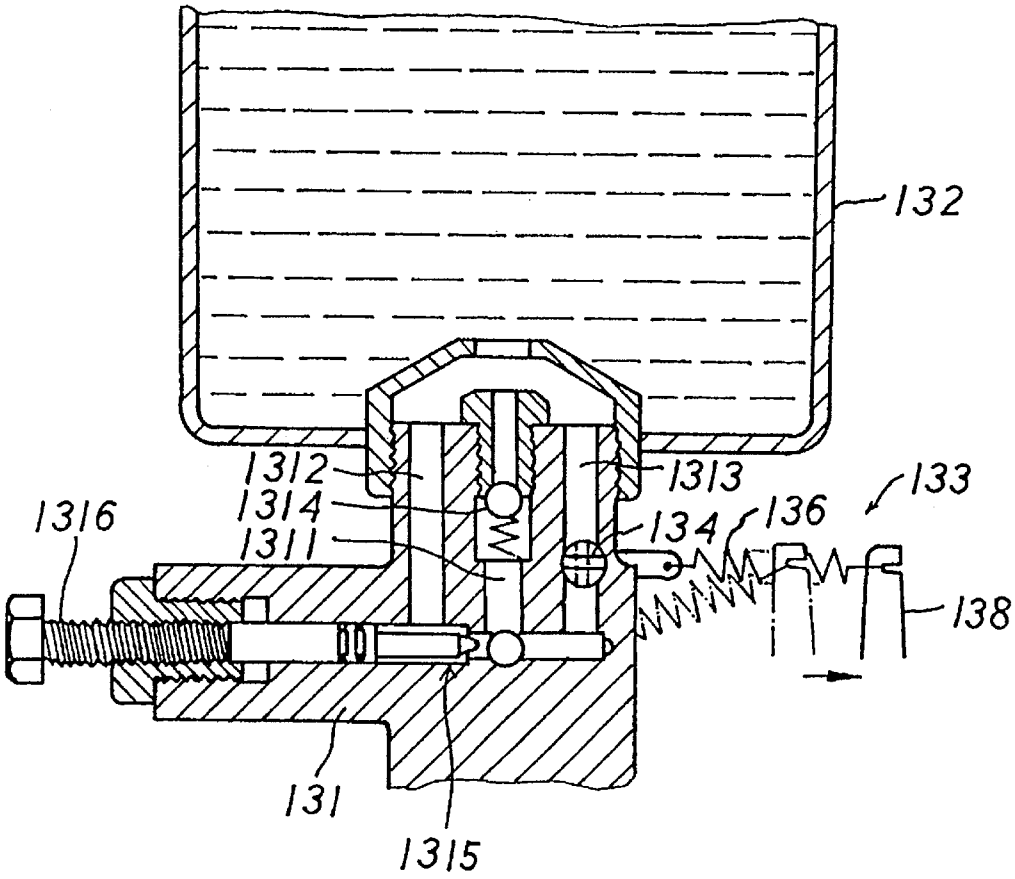
FIG. 4 is a sectional view, showing the hydraulic means of the present invention.
Figure 6:
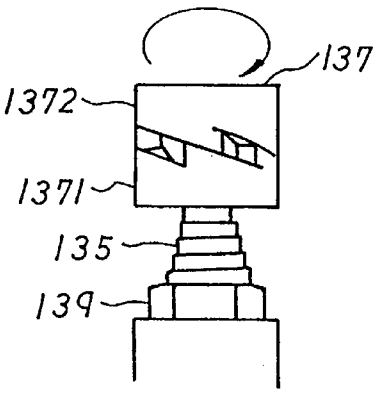
FIG. 6 shows the operation of a part of the flow controlling mechanism of the present invention.
Figure 5:
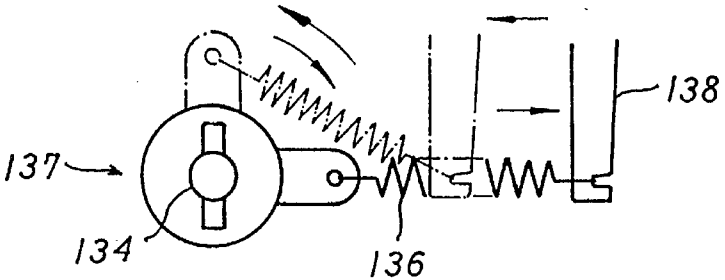
FIG. 5 shows the operation of the flow controlling mechanism of the present invention.
Figure 5:
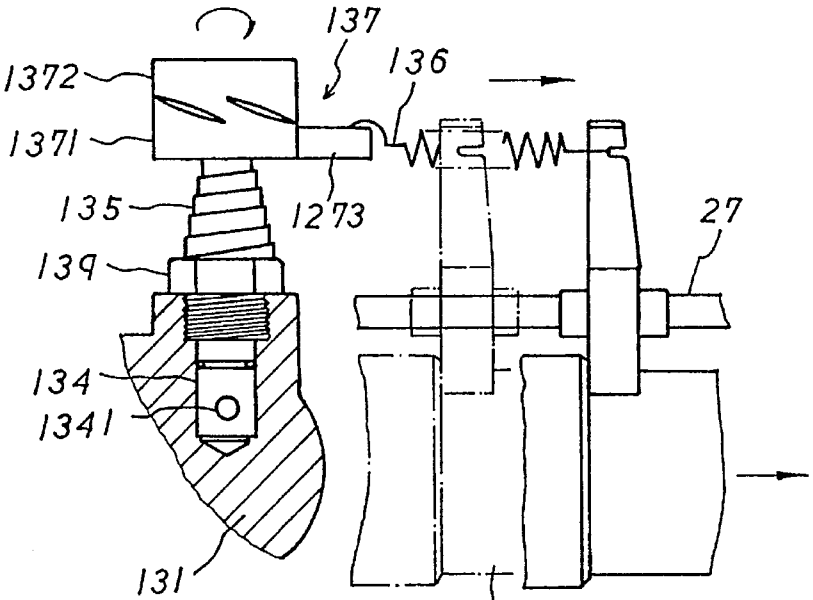
Figure 7:
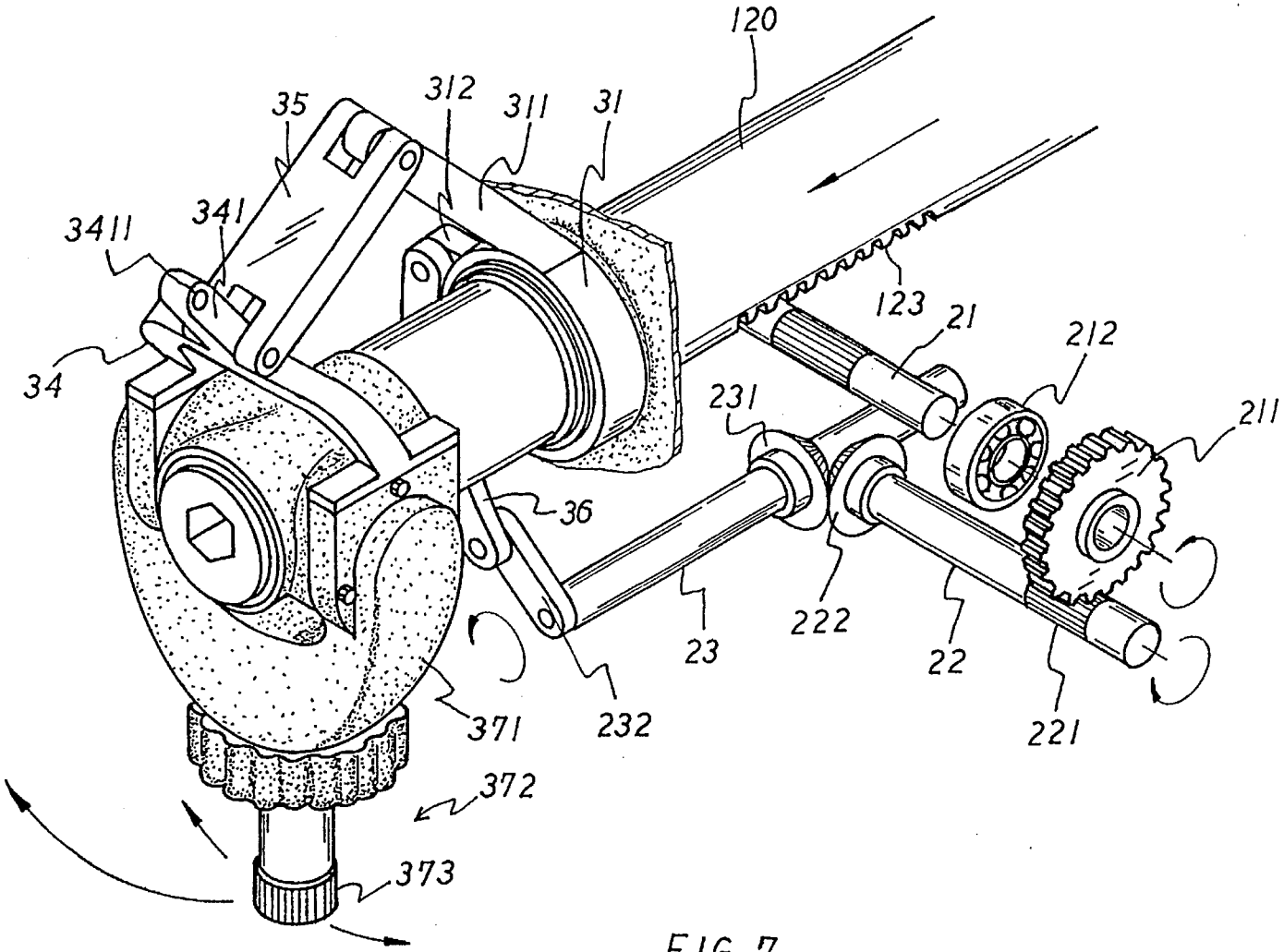
FIG. 7 is a perspective exploded view of the sprinkling system and transmission case of the present invention.
Figure 8:
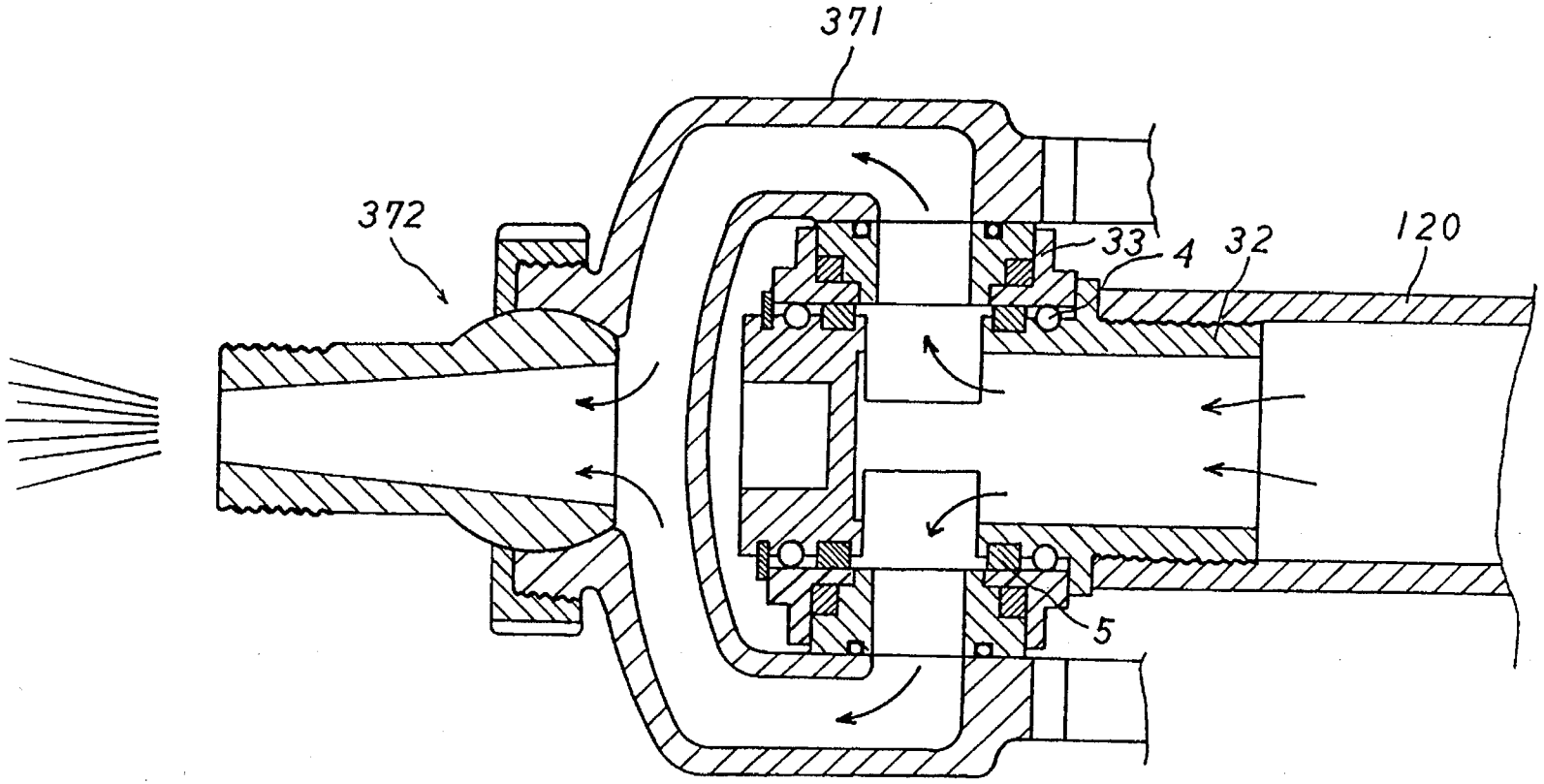
FIG. 8 is a sectional view showing the operation of the sprinkling system of the present invention.
Figure 9:
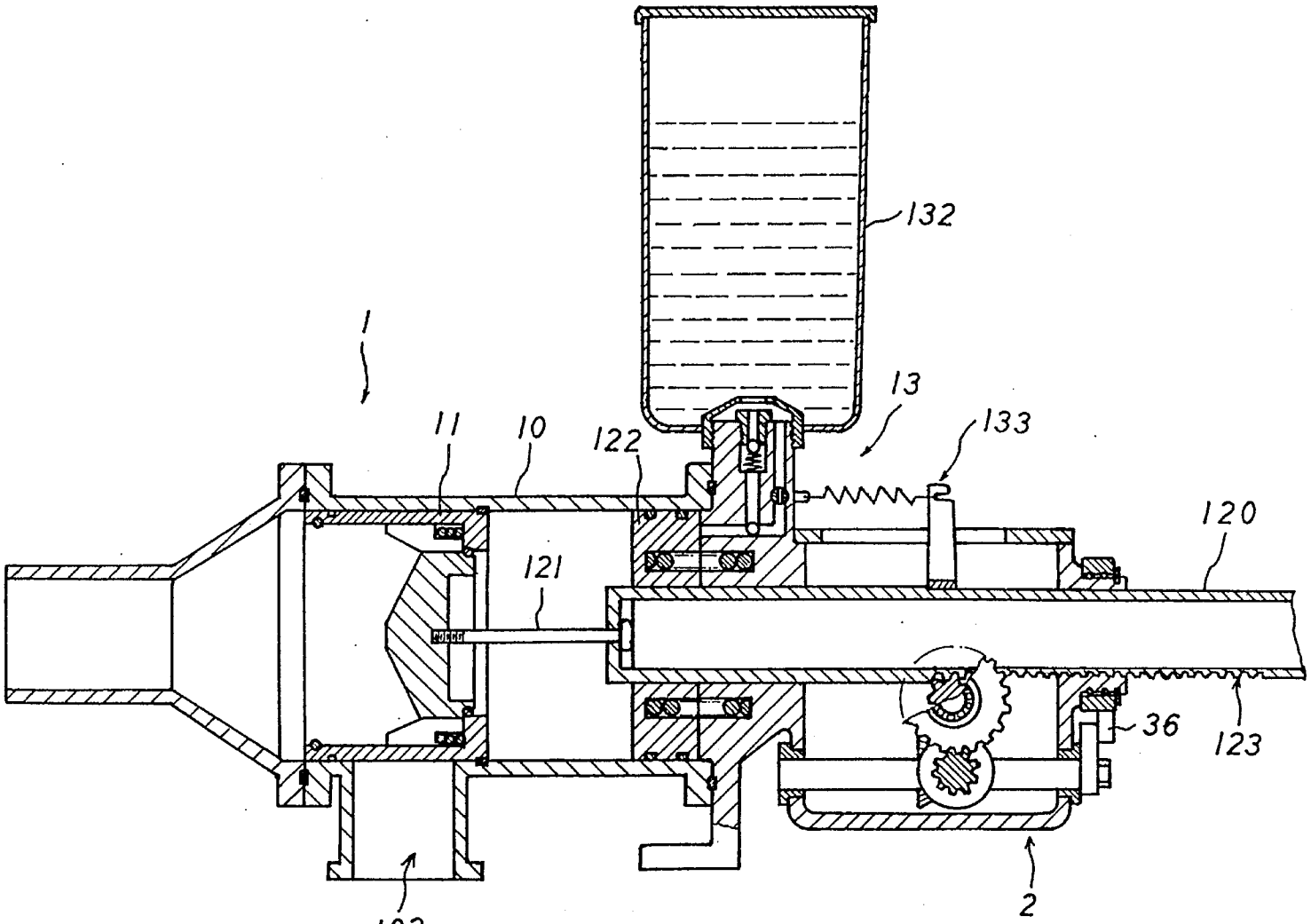
FIG. 9 is a sectional view of the present invention, showing that the valve body moves forward to block the water exit.
Figure 10:
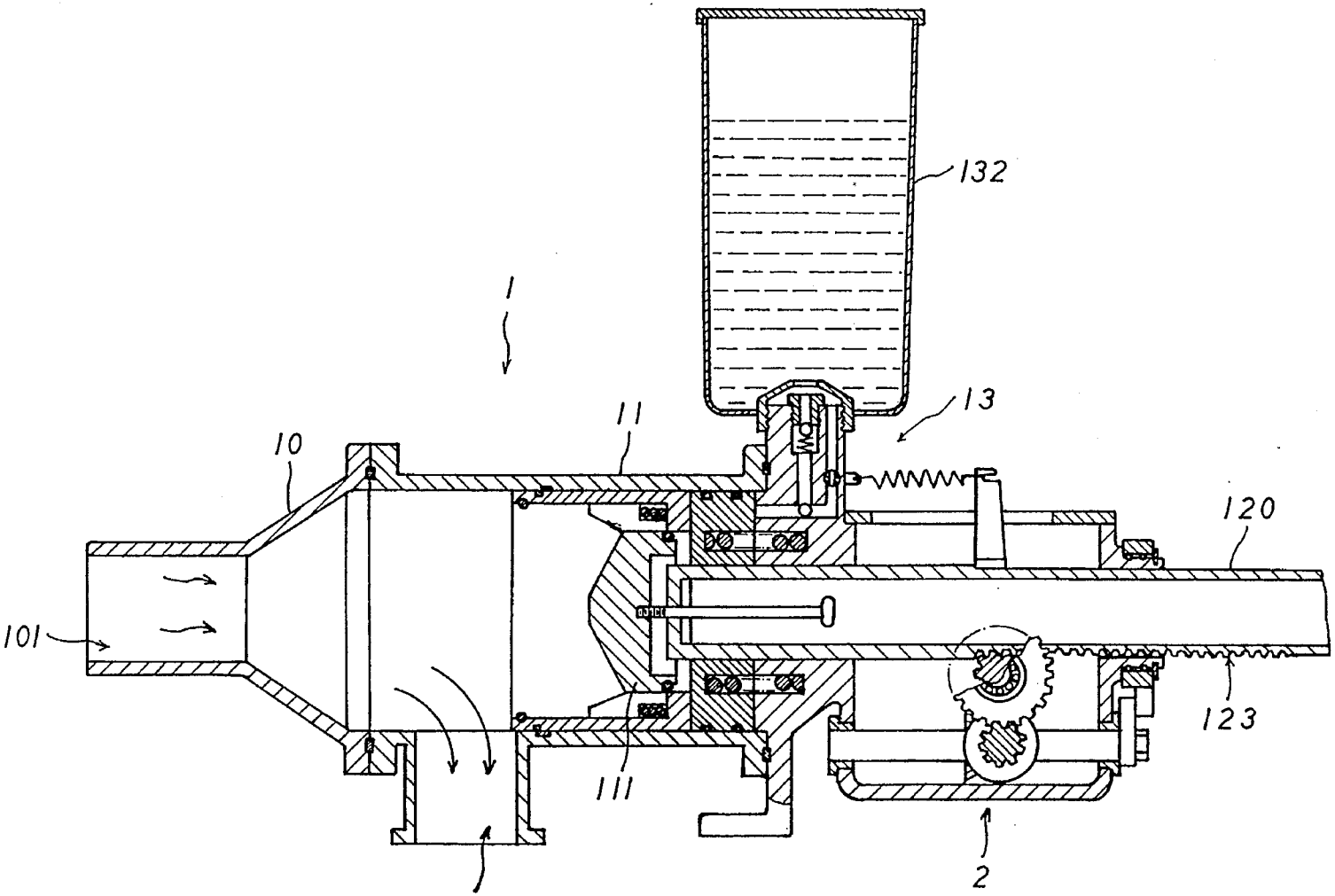
FIG. 10 is a sectional view according to FIG. 9, showing that the valve body together with the valve seat moves forward, permitting the water to flow into the bypass.
Figure 11:
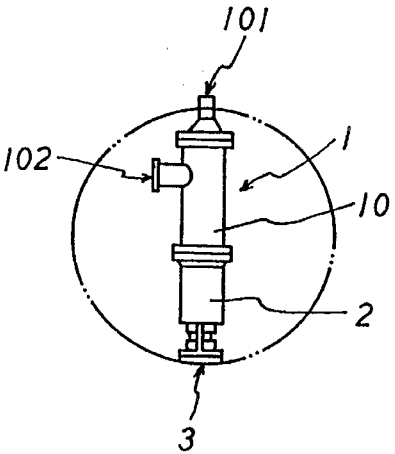
FIG. 11 is a reduced view of the present invention.
Figure 11A:
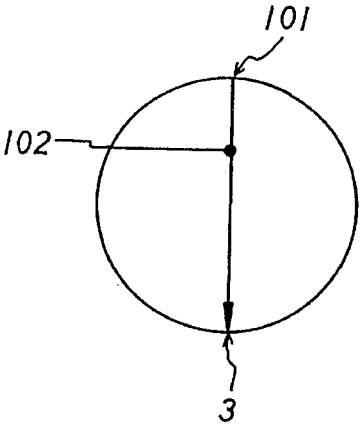
FIG. 11A is a schematic diagram according to FIG. 11.
Figure 11B:
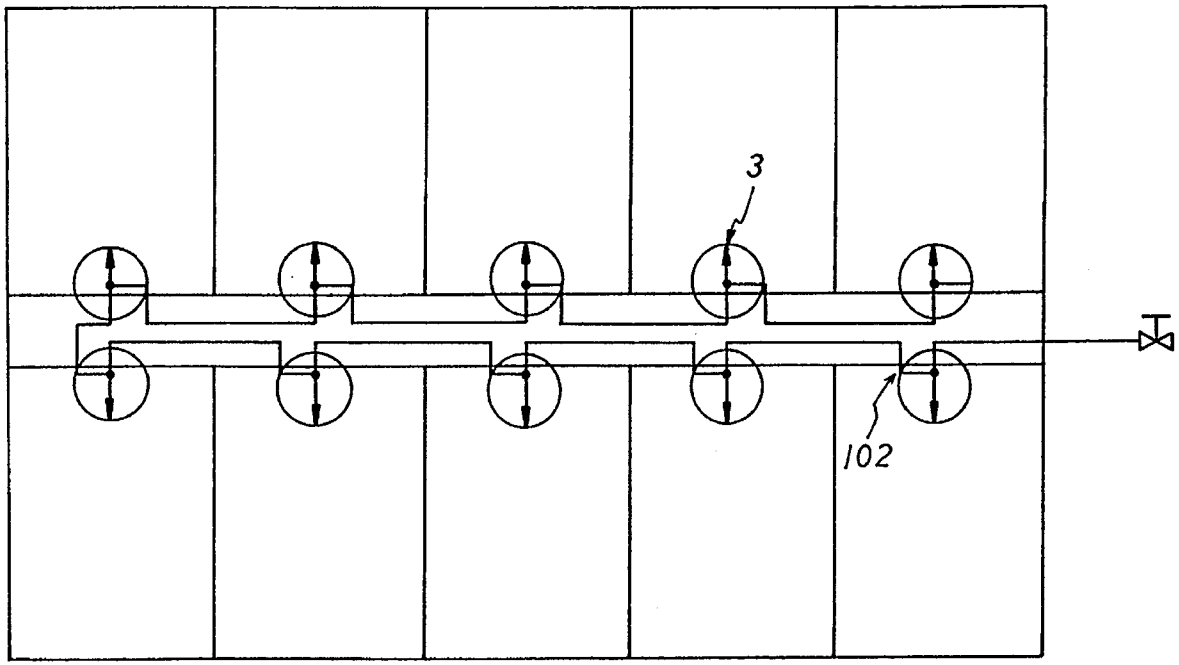
FIG. 11B shows a series of cleaning devices according to FIG. 11A.

Please refer to FIGS. 4 to 6. The hydaulic means 13 includes a main body 131, an oil cup 132 and a flow controlling mechanism 133. The main body 131 is screwed on a rear end of the main body 10 of the automatic switching system 1 and formed with a first, a second and a third passages 1311, 1312, 1313 communicating with the oil cup 132, wherein a one-way valve body 1314 is disposed in the first passage 1311. In addition, an adjusting hole 1315 is transversely formed on a lateral side of the main body 131 to communicate with the first and second passages 1311, 1312. An adjusting bolt 1316 is disposed in the adjusting hole 1315 for controlling the amount of the oil flow.

The flow controlling mechanism 133 includes a controlling lever 134, a bamboo shoot-like spring 135, a tension spring 136, a one-way ratchet assembly 137 and a slidable arch block 138. A top end of the controlling lever 134 is formed with a transverse through hole 1341 communicating with the third passage 1313 of the main body 131. The controlling lever 134 is fitted with the bamboo shoot-like spring 135 and the one-way ratchet assembly 137 and rotatably fixed on the main body 131 by a bolt 139. The one-way ratchet assembly 137 includes a male and a female disks 1371, 1372, wherein the female disk 1372 is fixed at one end of the controlling lever 134 by a pin member and the male disk 1371 has a lug 1373 connected with the tension spring 136 which is further connected with the slidable arch block 138. The slidable arch block 138 is slidably fitted on a slide rod 27 of the transmission case 2 and slightly contacts with the shaft rod 120 of the slidable piston 12. Since the shaft rod 120 is stepped, a large diameter portion of the shaft rod 120 can drive the slidable arch block 138 to slide along the slide rod 27. The sliding of the slidable arch block 138 will cause the one-way ratchet assembly 137 to rotate through 90 degrees. Because the female disk 1372 is fixed on the controlling lever 134, the controlling lever 134 is thus simultaneously driven to rotate through 90 degrees. Therefore, the position of the through hole 1341 of the controlling lever 134 can be adjusted to communicate with the third passage 1313 of the main body 131 or block the same so as to alternately perform a fast and a slow cleaning operation.

Please refer to FIGS. 1, 2, 3, 4 and 7. The slidable arch block 138 is slidably fitted on the slide rod 27 of transmission case 2. A splined circular rod 21 is rotatably disposed in the transmisstion case 2 for meshing with the teeth 123 of the shaft rod 120. A gear 211 is disposed at one end of the splined circular rod 21 and a one-way bearing 212 is disposed in the gear 211 so that the circular rod 21 can only drive the gear 211 to rotate in one direction. The gear 211 is further engaged with a splined portion 221 of a first rotary rod 22 to create a speeding effect. A bevel gear 222 is disposed at one end of the first rotary rod 22 to mesh with a bevel gear 231 of a second rotary rod 23 which is disposed perpendicular to the first rotary rod 22.

Please refer to FIGS. 1, 2, 7 and 8. The sprinkling system 3 includes a rotatable ring member 31, a connecting pipe 32, a three-way connector 33, a U-shaped swinging block 34, a linking lever 35, a connecting arch block 36 and a sprinkling means 37. The ring member 31 is rotatably fitted on the shaft rod 120 of the transmission case 2 and formed with a projection 311 pivotally connected with the linking lever 35 and a lug 312 pivotally connected with the connecting arch block 36. The connecting pipe 32 is connected with an end of the shaft rod 120 and formed with two opposite diametric through holes 321 and a close front end. The connecting pipe 32 is further formed with a first annular groove 322 for containing steel balls 4 and a second annular groove 323 for containing a waterproof washer 5 and connected with the three-way connector 33. By means of the steel balls 4, the three-way connector 33 can rotate relative to the connecting pipe 32 frictionlessly. The sprinkling means 37 includes a connecting block 371 and a sprinkling head 372 having a cap member 373. The connecting block 371 is U-shaped and formed with inner through hole which communicates with the three-way connector 33. The connecting block 371 is formed with an opening communicating with the sprinkling head 372. The U-shaped swinging block 34 is connected with the sprinkling means 37 and has an upward extending connecting block 341 on which several pivot holes 3411 are disposed at equal intervals. The linking lever 35 is pivotally connected between the projection 311 of the ring member 31 and the connecting block 341, whereby when the shaft rod 120 moves forward, because the ring member 31 can only rotate about the shaft rod 120 while unable to slide back and forth therealong, the ring member 31 via the linking lever 35 makes the swinging block 34 pivoted forward. At this time, because the swinging block 34 is fixedly connected with the sprinkling head 372 of the sprinkling means 37, the sprinkling head 372 is pivoted downward through a certain angle. The starting point of the sprinkling head 372 can be adjusted by means of changing the pivot holes 3411 of the connecting block 341 for the linking lever 35. A connecting plate 232 is fixed at one end of the second rotary rod 23 and pivotally connected with the connecting arch block 36. Furthermore, the connecting arch block 36 is pivotally connected with the lug 312 of the ring member 31, whereby when the second rotary rod 23 is rotated, via the connecting arch block 36, the ring member 31 is rotated through a certain angle. At this time, via the linking lever 35 and the swinging block 34, the sprinkling head 372 is swung left or right through a certain angle.

Please now refer to FIGS. 1 to 11. The cleaning device of the present invention is characterized in that the water pump is connected with the water entrance 101 of the main body 10 of the automatic switching system 1 through a water tube 101. The main body 10 contains hydraulic oil which is confined by the sealing disk 122 of the slidable piston 12. The hydraulic means 13 is screwed on the rear end of the main body 10 of the automatic switching system 1. The three passages 1311, 1312, 1313 of the main body 131 of the hydraulic means 13 communicate with the oil cup 132 and the adjusting bolt 139 and flow controlling mechanism 133 are used to control the amount of the oil flow. The shaft rod 120 extends through the rear end of the main body 10 into the interior thereof so as to transmit the hydraulic power to and drive the splined circular rod 21 and the first and second rotary rods 22, 23 in the transmission case 2 which convert the linear movement of the shaft rod 120 into the rotary movement of the sprinkling head 372. The sprinkling means 37 is connected with the rear end of the shaft rod 120, whereby by means of the cooperation of the linking lever 35 and the connecting arch block 36, the linear movement of the shaft rod 120 and the rotary movement of the second rotary rod 23 result in the up and down pivoting movement and left and right swinging movement of the sprinkling head 372. Also, by means of changing the pivot holes 3411 of the connecting block 341 for pivotally connecting with the linking lever 35, the starting point of the sprinkling head 372 can be adjusted.

The above arrangements operate in such a manner that when the water pump pumps water into the water entrance 101 of the main body 10 of the automatic switching system 1, the valve seat 11 blocks the bypass 102 and thus the water flows through a clearance between the valve seat 11 the conic valve body 111 into the through hole 126 of the slidable piston 12 to be sprinkled out by the sprinkling head 372. The sealing disk 122 of the slidable piston 12 suffers the pushing force from the incoming water and thus the shaft rod 120 is moved forward gradually. At this time, the hydraulic oil is forced into the oil cup 132. Because the slidable piston 12 is fixedly connected with the conic valve body 111 by the linking rod 121, when the shaft rod 120 moves forward, the conic valve body 111 is pulled to gradually compress the compression spring 112 which is disposed in front of the valve body 111. At this time, the valve seat 11 is restricted from moving by the O-rings 104 in the main body 10 by reason that the water pushing force exerted on the conic valve body 111 is able to compress the compression spring 112 while the compression force of the compression spring 112 is smaller than the maximum restricting force of the O-rings 104 on the valve seat 11 and thus is unable to move the valve seat 11. However, when the conic valve body 111 reaches the water exit and blocks the same, the water pushing force will totally act on the conic valve body 111. The total water pushing force is greater than the maximum restricting force of the O-rings 104 and therefore the valve seat 11 is instantly slid forward, making the water flow through the bypass 102 of the main body 10 into a next cleaning device. When the through hole 1341 of the front end of the controlling rod 134 of the flow controlling mechanism 133 is aligned with the third passage 1313 of the main body 131 of the hydraulic means 13 and communicated therewith, the hydraulic oil in the main body 10 can fast flow into the oil cup 132 so that the slidable piston 12 suffers less resistance and can move fast to achieve a fast cleaning effect. After this travel is over, the slidable arch block 138 is driven by the stepped portion of the shaft rod 120 and the controlling rod 134 is driven by the ratchet assembly 137 to rotate through 90 degrees, making the front end of the controlling rod 134 block the third passage 1313 of the main body 131 of the hydraulic means 13, whereby the hydraulic oil will flow back to the oil cup 132 at a relatively slow speed in the next travel and thus the next cleaning procedure will be slowed down. By means of the cooperation of the ring member 31, the U-Shaped swinging block 34, the linking lever 35 and the connecting arch block 36, the linear movement of the shaft rod 120 and the rotary movement of the second rotary rod 23 result in the simultaneous up and down pivoting movement and left and right swinging movement of the sprinkling head 372. Also, in case it is desired to clean only a rear half area of the stock farm, by means of changing the pivot holes 3411 of the connecting block 341 for pivotally connecting with the linking lever 35, the starting point of the sprinkling head 372 can be adjusted and the sprinkling head 372 can sprinkle from a middle area of the stock farm to a rear area thereof.

The above preferred embodiment is only an example of the present invention and the scope of the present invention should not be limited to the example. Any modification or variation derived from the example should fall within the scope of the present invention.

What is claimed is:

1. An automatic cleaning device for use on a stock farm, comprising a switching system, a transmission case and a sprinkling system, wherein:

said automatic switching system includes a main body, a valve seat, a slidable piston and a hydraulic means, said main body having a water entrance for receiving water pumped in by a water pump, a bypass disposed on a lateral side of said main body, an interior space for containing said valve seat and said slidable piston and two O-rings embedded in said main body for restricting said valve seat from moving, wherein:

said valve seat has a conic valve body disposed in said valve seat, a compression spring disposed at a rear end of said conic valve body confined between a rear end of said valve seat, an engaging step portion and an annular groove being respectively formed at two ends of said valve seat for engaging with said O-rings of said main body, a thread hole being formed on a central portion of said rear end of said conic valve body;

said slidable piston being a hollow tube member having a through hole, a sealing disk being disposed at a front end of said slidable piston for completely shutting off water flow, a shaft rod axially extending from a rear end of said sealing disk, said shaft rod being stepped, having a large diameter portion and a small diameter portion, a row of teeth being axially formed on an outer wall of a bottom of said small diameter portion of said shaft rod, a U-shaped member being fixedly disposed at a front end of said slidable piston across said through hole, an orifice being formed at a central portion of said U-shaped member, whereby a linking rod is fixed in said orifice to screw into said thread hole of said conic valve body, a restoring spring being fitted on said shaft rod of said slidable piston; and said hydaulic means includes a main body, an oil cup and a flow controlling mechanism, wherein said main body of said hydraulic means is screwed on a rear end of said main body of said automatic switching system and formed with a first, a second and a third passage, each communicating with said oil cup, a one-way valve body being disposed in said first passage, an adjusting hole being transversely formed on a lateral side of said main body of said hydraulic means to communicate with each said first and second passage, an adjusting bolt being disposed in said adjusting hole for controlling amount of oil flow, said flow controlling mechanism including a controlling lever, a bamboo shoot-like spring, a tension spring, a one-way ratchet assembly and a slidable arch block, a top end of said controlling lever being formed with a transverse through hole communicating with said third passage of said main body of said hydraulic means, said controlling lever being fitted with said bamboo shoot-like spring and said one-way ratchet assembly and rotatably fixed on said main body of said hydraulic means by a bolt, said one-way ratchet assembly including a male and a female disks, wherein said female disk is fixed at one end of said controlling lever by a pin member, said male disk having a lug connected with said tension spring which is further connected with said slidable arch block, said slidable arch block being slidably fitted on a slide rod of said transmission case and slightly contacts with said shaft rod of said slidable piston;

a splined circular rod is rotatably disposed in said transmisstion case for meshing with said teeth of said shaft rod, a gear being disposed at one end of said splined circular rod and a one-way bearing being disposed in said gear so that said circular rod drives said gear to rotate in only one direction, said gear being further engaged with a splined portion of a first rotary rod to create a speeding effect, a bevel gear being disposed at one end of said first rotary rod to mesh with a bevel gear of a second rotary rod which is disposed perpendicular to said first rotary rod; and said sprinkling system includes a rotatable ring member, a connecting pipe, a three-way connector, a U-shaped swinging block, a linking lever, a connecting arch block and a sprinkling means, wherein said ring member is rotatably fitted on said shaft rod of said transmission case and formed with a projection pivotally connected with said linking lever and a lug pivotally connected with said connecting arch block, said connecting pipe being connected with an end of said shaft rod and formed with two opposite diametric through holes and a close front end, said connecting pipe being further formed with a first annular groove for containing steel balls and a second annular groove for containing a waterproof washer and connected with said three-way connector, whereby by means of said steel balls, said three-way connector is able to rotate relative to said connecting pipe frictionlessly, said sprinkling means including a connecting block and a sprinkling head, said connecting block being U-shaped and formed with inner through hole which communicates with said three-way connector, said connecting block being formed with an opening communicating with said sprinkling head, said U-shaped swinging block being connected with said sprinkling means and having an upward extending connecting block on which several pivot holes are disposed at equal intervals, said linking lever being pivotally connected between said projection of said ring member and said connecting block, whereby when said shaft rod moves forward, because said ring member is only able to rotate about said shaft rod while unable to slide back and forth therealong, said ring member via said linking lever makes said swinging block pivot forward and at this time, because said swinging block is fixedly connected with said sprinkling head of said sprinkling means, said sprinkling head is pivoted downward through a certain angle, a starting point of said sprinkling head is adjustable by means of changing said pivot holes of said connecting block for pivotally connecting with said linking lever, said cleaning device being characterized in that said water pump is connected with said water entrance of said main body of said automatic switching system through a water tube, said main body of said automatic switching system containing hydraulic oil which is confined by said sealing disk of said slidable piston, said hydraulic means being screwed on said rear end of said main body of said automatic switching system, said three passages of said main body of said hydraulic means communicating with said oil cup and said adjusting bolt and flow controlling mechanism being used to control the amount of oil flow, said shaft rod extending through said rear end of said main body of said automatic switching system into said interior thereof so as to transmit hydraulic power to and drive said splined circular rod and said first and second rotary rods in said transmisstion case which convert linear movement of said shaft rod into rotary movement of said sprinkling head, said sprinkling means being connected with said rear end of said shaft rod, whereby by means of cooperation of said linking lever and said connecting arch block, said linear movement of said shaft rod and said rotary movement of said second rotary rod result in up and down pivoting movement and left and right swinging movement of said sprinkling head, and by means of changing said pivot holes of said connecting block for pivotally connecting with said linking lever, the starting point of said sprinkling head is adjustable.

* * * * *